US006923730B1

(12) United States Patent
Potter

(10) Patent No.: US 6,923,730 B1
(45) Date of Patent: Aug. 2, 2005

(54) PUTTING STROKE TRAINING DEVICE

(76) Inventor: Thomas J. Potter, 505 St. Croix Ct., DeForest, WI (US) 53532

( * ) Notice: Subject to any disclaimer, the term of this patent is extended or adjusted under 35 U.S.C. 154(b) by 0 days.

(21) Appl. No.: 10/789,885

(22) Filed: Feb. 27, 2004

(51) Int. Cl.[7] ..... A63B 69/36
(52) U.S. Cl. ..... 473/257; 473/265
(58) Field of Search ..... 473/257–270, 473/272, 219; D21/790; 273/DIG. 30, DIG. 4; 33/1 R, 558.01, 501.04

(56) References Cited

U.S. PATENT DOCUMENTS 1,824,644 A * 9/1931 Webb ..... 294/117
3,308,538 A * 3/1967 Peck ..... 33/27.02
D273,803 S * 5/1984 Johnson ..... D21/790
4,526,373 A * 7/1985 Medlock ..... 473/265
5,209,484 A * 5/1993 Randall ..... 473/265
5,320,355 A * 6/1994 Johnson ..... 473/265
5,785,604 A * 7/1998 Johnson ..... 473/265
5,882,267 A * 3/1999 Roe ..... 473/265
6,443,852 B1 * 9/2002 Kim ..... 473/265

* cited by examiner

*Primary Examiner*—Gregory Vidovich
*Assistant Examiner*—Nini F. Legesse
(74) *Attorney, Agent, or Firm*—Whyte Hirschboeck Dudek SC

(57) ABSTRACT

A putting stroke training device has two adjustable arms, each joined to an elevated arch at the "closed end" of the device. Preferably, the elevated arch is of sufficient dimensions to allow a golf ball to travel underneath and through the arch. Each arm may be connected to the elevated arch by a wing nut and screw which can be locked down to set each arm at adjustable angles. A guide ball is affixed to the opposite end of each arm at its "open end." One of the arms is also connected to a vertical marker which shows the user where the golf ball is in the user's stance. The arms may be rotated to open the device to accommodate the width of a putter swinging through the distance between each guide ball on the open ends of the arms. A method of using the device is also included.

20 Claims, 3 Drawing Sheets

PUTTING STROKE TRAINING DEVICE

FIELD OF THE INVENTION

This invention relates generally to devices that assist golfers in improving their game and, more particularly, to devices that assist in perfecting a golfer's putting stroke.

BACKGROUND OF THE INVENTION

A major problem encountered in perfecting the game of golf is the development of consistency in a golfer's putting stroke. In order to perfect one's putting stroke, practice devices have been developed so that the golfer can repetitively practice putting in order to improve the consistency of his stroke.

Many of the devices in the prior art are "box" type putting devices of a fixed size and shape. Such devices do not provide for adaptation to the size of putter used nor do they provide the user with the ability to practice using a natural putting stroke having "follow through" in the swing of the putter. The user of these prior art designs is forced to stop the putter "short" in order to avoid hitting the device during the "follow through" motion of his swing. Other devices in the prior art are flat surfaced devices having lines for putter guidance. Such devices offer no targets to access accuracy.

There is a need for a putting stroke training device that provides flexibility whereby the golfer can practice his putting stroke with the device outside in a natural environment on a lawn or golf course or, alternatively, inside a building on a carpeted surface. There is also a need for a device that is adjustable to accommodate different sizes and styles of putters.

There is also a need for a device that is weighted and can be anchored so that it will stay in position during use. Furthermore, there is a need for a device that captures the balls during use for easy reuse.

There is also a need for a device that can be accommodated for use by both right and left handed golfers and a device that can be adjusted to the individual stance of the user. Additionally, there is a need for a device that is designed so as to allow the use of a natural putting stroke during practice so that consistency can be developed and the practiced and perfected stroke repeated during an actual golf game.

OBJECTS OF THE INVENTION

It is an object of the invention to provide an improved putting device for use by golfers to improve and perfect their putting stroke. In particular, there is a need for a putting stroke device that allows the golfer to use the same stroke with the device as the stroke used on a golf course during a game. A further object of the device is to provide a device of a shape and design that will not interfere with the putter's natural stroke when used.

Another object of the invention is to provide a device that is adjustable to accommodate use with putters of various sizes and styles. Still another object of the invention is to provide a marker so that the user can easily mark the ball position in his stance when using the device. Yet another object of the invention is to provide for a device that may easily be used outside in a natural environment or inside on a carpeted surface.

Yet another object of the invention is to provide for a device that is sufficiently weighted or anchored so that it can be locked in a fixed position during indoor or outdoor use.

Another object of the invention is to provide for a detachable net so that, when the net is attached, the balls traveling through the device may be stopped within a certain distance from the device and easily gathered by the user for reuse and, further, that allows the net to easily be removed for use of the device on outdoor surfaces. Yet a further object of the invention is to provide for a device that accommodates both right and left handed golfers. How these and other objects are accomplished will become apparent from the following descriptions and from the drawings.

SUMMARY OF THE INVENTION

The invention is a putting stroke training device for use in training a user to develop a consistent and accurate swing in practicing putting. The device has a first arm having a first arm closed end and a first arm open end, a second arm having a second arm closed end and a second arm open end, an elevated arch attached to the first arm of the first arm closed end and also attached to the second arm at the second arm closed end. The device also has a means of attachment of the elevated arch to the first arm closed end and the second arm closed end. In the preferred embodiment, the elevated arch is of sufficient dimensions to allow the passage of a golf ball therethrough on a path equally dividing the device along its length.

In a preferred embodiment, the first arm is rotatable around the means of attachment between the first arm closed end and the elevated arch. Furthermore, the second arm is rotatable around the means of attachment between the second arm closed end and the elevated arch. The means of attachment of the first arm closed end to the elevated arch and the second arm closed end to the elevated arch may be by means of wing nuts and screws, although other means of attachment are also possible. Preferably, the second arm is connected at the second arm open end to a marker extending in a direction perpendicular from a line drawn through the device along its center length. In one embodiment, the marker can be removably detached from the second arm open end and alternatively affixed to the first arm open end.

In a preferred embodiment of the invention, the rotatable means of attachment between the first arm closed end and the elevated arch and for rotating the second arm closed end around the attachment to the elevated arch are lockstepped grooves.

In one aspect of the invention, the device also comprises means for catching a golf ball traveling therethrough. In a preferred embodiment of this device, the means for catching the golf ball is a net removably attached to the device. In one aspect, the elevated arch has an elevated arch right side and an elevated arch left side and the net is removably attached to the elevated arch on the elevated arch right side and the elevated arch left side. The means of removable attachment of the net to the elevated arch may be by means of Velcro, although alternative means are also possible and included herein.

In a preferred embodiment of the device, the first arm and the second arm each include means for stabilizing the device. The means for stabilizing the device may be anchors. In a preferred embodiment of the device, the first arm and the second arm may have at least one hole each therethrough whereby stabilizing means, such as golf tees, may pass therethrough and be driven into the ground.

The device may also have a first arm guide ball affixed to the first arm open end and a second arm guide ball affixed to the second arm open end. In a preferred embodiment of the device, the first arm is a mirror image of the second arm. This embodiment may give the device an overall horseshoe-like curve shape.

In yet another aspect of the invention, a method for making a putting stroke training device is described comprising a first arm having a first arm closed end and a first arm open end, as well as a second arm having a second arm closed end and a second arm open end. An elevated arch is attached to the first arm of the first arm closed end and the second arm at the second arm closed end, and there are means of attachment of the elevated arch to the first arm closed end and to the second arm closed arm. This method may also comprise a method for making a putting stroke training device wherein the elevated arch is of sufficient dimensions to allow the passage of a golf ball therethrough on a path dividing the device along its length.

Other aspects of the invention are set forth in the following detailed description and in the drawing.

DETAILED DESCRIPTION OF THE PREFERRED EMBODIMENTS

Figure 1:
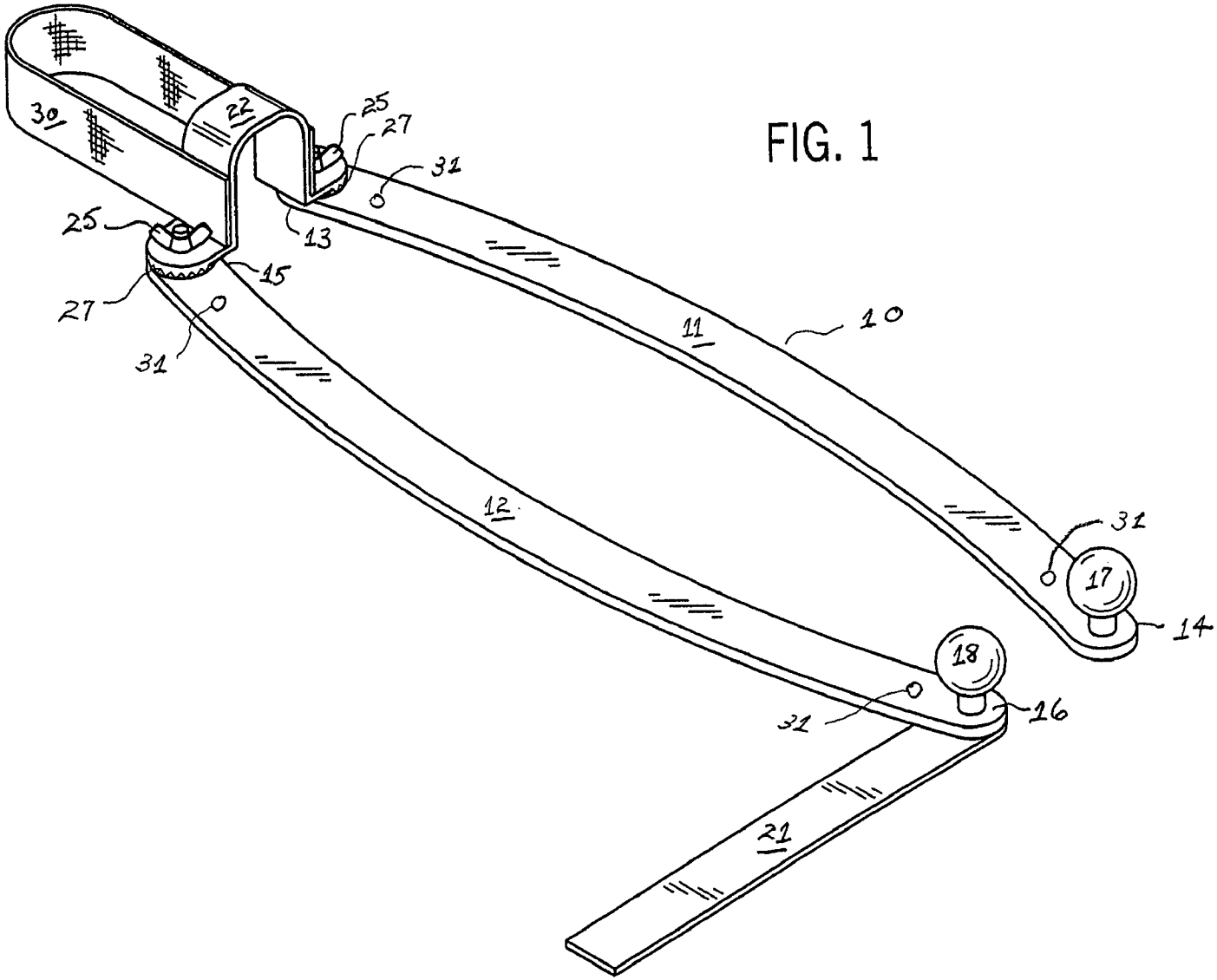
FIG. 1 is a perspective view of the preferred embodiment of the device.

FIG. 1 shows a preferred embodiment of the new putting stroke training device 10. The device 10 is constructed to allow the use of a putter in a natural stroke when practicing and perfecting putting technique. The device 10 provides for this by allowing an opening sufficient to allow the free flowing travel of a putter in a natural swing at the open end of the device 10.

The preferred embodiment of the device 10 as shown in FIG. 1 consists of two elongated arms, a first arm 11 and a second arm 12, each preferably constructed of a weighted substance such as steel or some other metal and of a thickness of approximately one-quarter inch. Other materials and thicknesses of materials could also be used. Each of the arms 11 and 12 are approximately twenty-four inches in length and each have at least one hole 31 therethrough whereby an anchoring device, such as an ordinary golf tee, could pass for anchoring purposes. The preferred embodiment of the device 10 has two holes 31 in the first arm 11 and two holes 31 in the second arm 12, as shown in FIG. 1. The first arm 11 and the second arm 12 are preferably mirror images of one another, although this is not required. The first arm 11 has a first arm closed end 13 and a first arm open end 14. The second arm 12 has a second arm closed end 15 and a second arm open end 16.

In a preferred embodiment, a first arm guide ball 17 is attached through a hole in the first arm open end 14 and a second arm guide ball 18 is attached through a hole in the second arm open end 16. The first arm guide ball 17 and the second arm guide ball 18 act as guide balls for the user of the device 10 in practicing his stroke. The first arm guide ball 17 is affixed to the first arm open 14 end by the use of a screw 19 passing from the bottom of the device 10 through the first arm 11 into the first arm guide ball 17. The second arm guide ball 18 is affixed to the second arm open end 16 by the use of a screw 19 passing through the bottom of the second arm 12 into the second guide ball 18. Preferably, the exposed metal of the screws 19 are covered with small rubber bases 20.

If the user of the device 10 makes an accurate stroke on the golf ball 28 with a putter, the putter will swing easily between the guide balls 17, 18. However, if the putter strikes either of the guide balls 17, 18, the user will easily recognize that the stroke was incorrect. It therefore can be observed how the use of guide balls 17, 18 can assist the user of the device 10 to perfect his stroke by communicating through free movement in the stroke when the stroke is correct. The device 10 therefore assists the user to recognize when the stroke is correct and thereby allow him to perfect his stroke through repetition and practice with the device 10.

Figure 2:
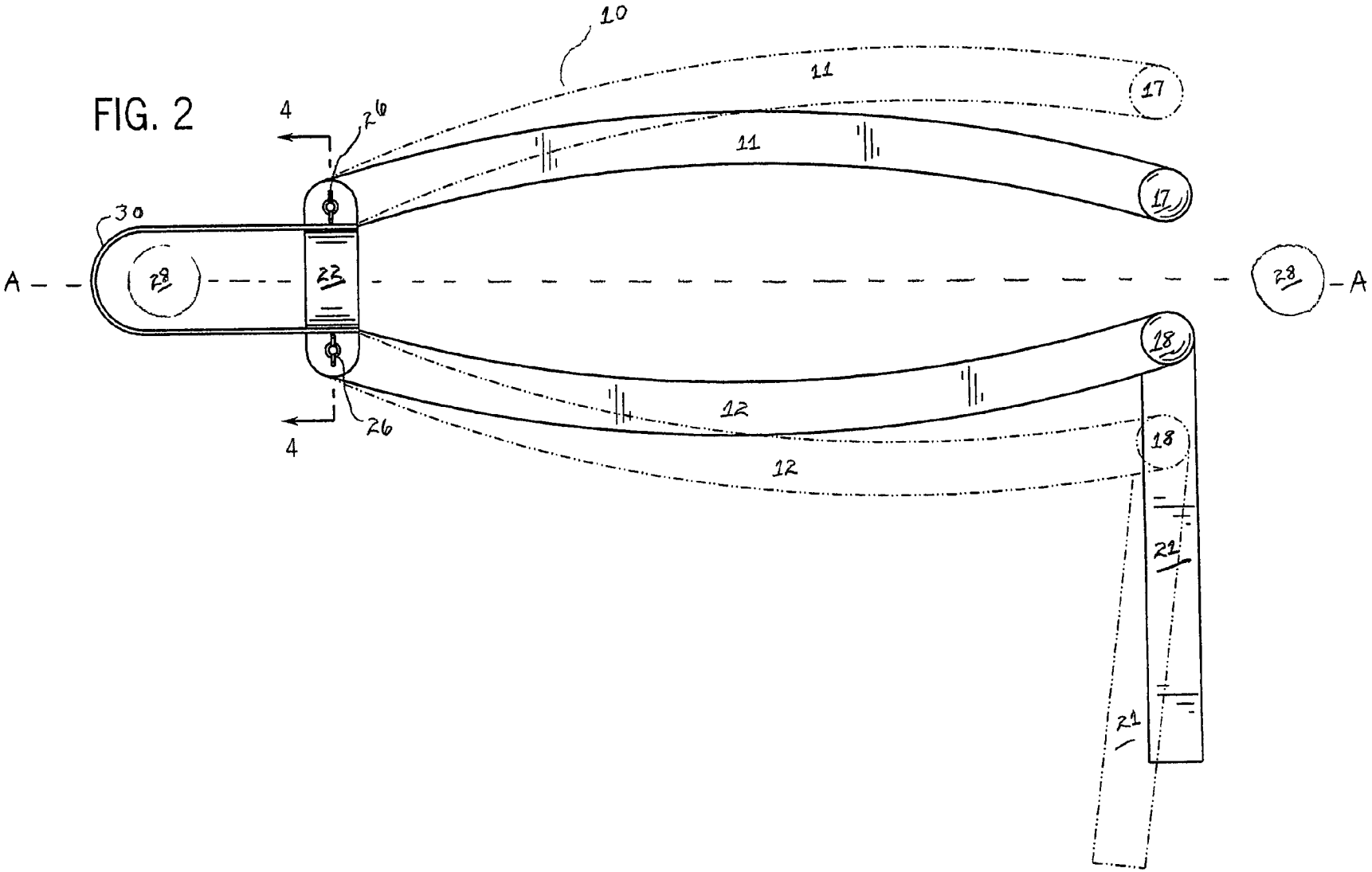
FIG. 2 is a top view of the preferred embodiment of the device, referencing cutaway view 4—4 shown in FIG. 4 and showing the rotation of the first arm and the second arm, as well as the approximate movement of the golf ball traveling through the device when the device is in use, shown in phantom lines along the imaginary line A—A.
Figure 3:
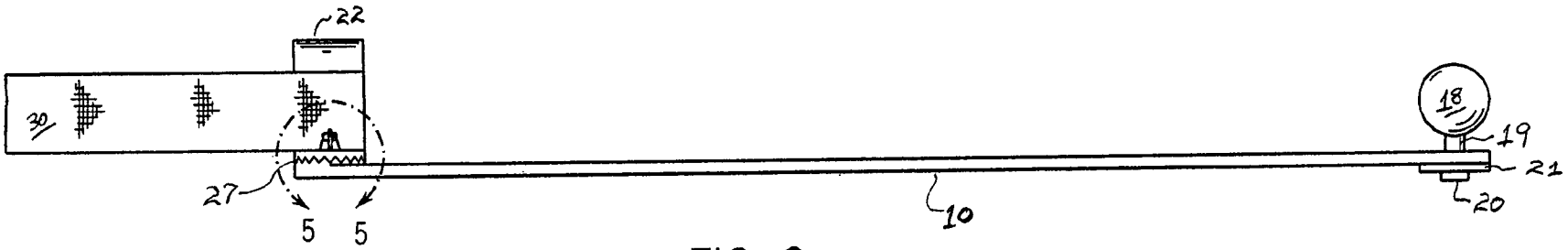
FIG. 3 is a side view of the device referencing a cutaway portion of the drawing 5—5 shown in FIG. 5.
Figure 5:
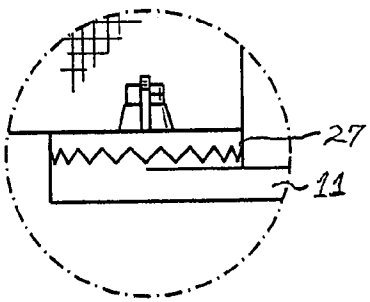
FIG. 5 is an enlarged view of 5—5 in FIG. 3, showing the step-locked rotation of the second arm due to the lock-stepped grooves.

As shown in FIGS. 1 and 2, in a preferred embodiment of the device 10, a ball position marker 21 is also attached to the second arm open end 16. The ball position marker 21 is preferably manufactured of a piece of metal similar in thickness and type to that used for the first arm 11 and the second arm 12, although it can also be made of different materials. The ball position marker 21 projects perpendicularly from a line (A—A) running through the center of the length of the device 10. The ball position marker 21 is preferably twelve inches in length and one and one-half inches in width, although alternative sizes could be used in the device and are intended to be included herein. In a preferred embodiment, the ball position marker 21 may be removably affixed to either the first arm 11 or the second arm 12 to accommodate both right and left handed golfers.

Figure 4:
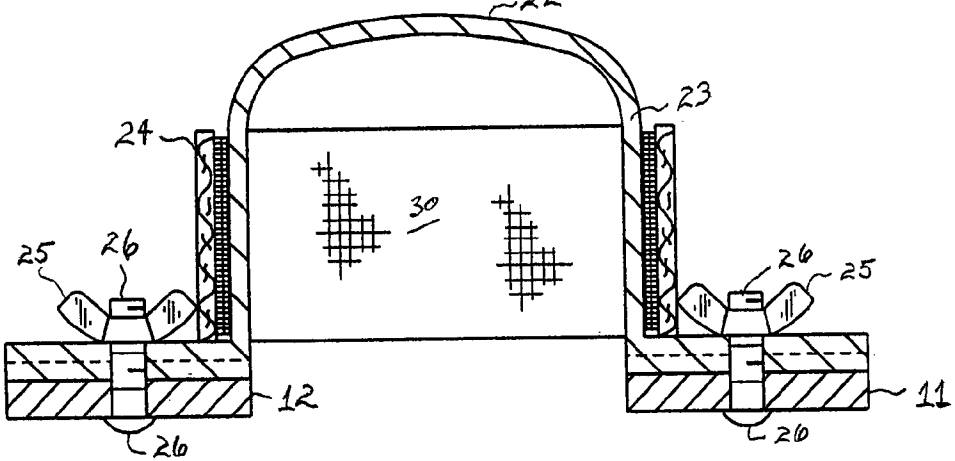
FIG. 4 is a cutaway view of 4—4 in FIG. 2, showing attachment of the first arm and the second arm and attachment of the net to the elevated arch.

Turning to FIG. 4, the device 10 also comprises an elevated arch 22 having an elevated arch right side 23 and an elevated arch left side 24 made of similar material as the arms 11, 12 of the device 10. The first arm closed end 13 is attached to the elevated arch right side 23 and the second arm closed end 15 is attached to the elevated arch left side 24. The attachment may be by varied means, but preferably through the use of a screw 25 and wing nut 26 combination, which can easily be unfastened to provide for easy rotation of the first arm 11 or second arm 12, as shown in FIG. 2. The device 10 preferably is constructed to allow the arms 11, 12 to rotate in order to accommodate varied openings between the two guide balls 17, 18 at the first arm open end 14 and the second arm open end 16.

In a preferred embodiment of the device 10, the rotation is by means of a lockstep grooves 27 so that, once the device 10 is fixed, it will remain in position unless the position is deliberately changed. In a preferred embodiment, the first arm 11 is a mirror image of the second arm 12 and has an outward curvature so that when the device 10 is viewed from above, as in FIG. 2, it has an overall elongated horseshoe appearance. However, it should be noted that alternative shapes are equally feasible and are intended to be included in this disclosure.

The elevated arch 22 is of sufficient dimensions to allow the easy movement of a golf ball 28 therethrough. A preferred embodiment of the elevated arch 22 would provide for an opening therethrough of approximately two and one-half inches in height and two and one-quarter inches in width. The length of the device 10 from the elevated arch to the open end of the arms 14, 16 is preferably 24 inches, although alternative lengths are also feasible. However, it is determined that this length is preferable to allow a natural putting stroke between the two guide balls 17, 18 without the possibility of hitting the elevated arch 22 with a putter. The length of the device 10 also provides stability and is of a sufficient length to provide some challenge to the user in perfecting his stroke.

A preferred embodiment of the device 10, particularly one for use indoors, further comprises means for catching a golf ball 28, preferably a net 30 attached at the end of the device 10 opposite the guide balls 17, 18 and ball position marker 21, although alternative means of capturing golf balls 28 could also suffice. The net 30 is preferably detachable and can be affixed to the device 10 by various means and in various locations. However, the net 30 is preferably affixed to the elevated arch right side 23 and the elevated arch left side 24 by use of Velcro strips or some other means of removable attachment. Preferably, the net 30 would extend beyond the elevated arch 22 by about six inches.

To use the device 10, the golfer fixes the arms 11, 12 of the device 10 in a sufficiently "open" position to allow the head of the chosen putter to pass between the guide balls 17, 18 without touching them. The golfer then stands with his feet parallel to the ball position marker 21 with the golf ball 28 placed between the two guide balls 17, 18. The ball position marker 21 is rotated to extend at 90° from line A—A after the two guide balls 17, 18 are opened to properly accommodate the width of the head of the putter being used. The ball position marker 21 shows the user where the golf ball 28 rests in the user's stance when struck by the putter head. It is important for golfers to know where the golf ball 28 rests in the golfer's stance in order to putt accurately. If the golf ball 28 is too far back in the stance, the putter blade will be "open" and the golf ball 28 will bear right after the putt. If the golf ball 28 is too far forward the putter will be "closed" and the golf ball 28 will bear left. Using the ball position marker 21 allows the golf ball 28 to be placed in the proper position in the user's stance each time the user putts. The user hits the golf ball 28 through the length of the device 10, under the elevated arch 22 and into the net 30.

The device 10 can be used for putting practice outdoors by removing the net 30, so as to allow the golf ball 28 to travel on natural grass putting greens into holes at multiple distances. This allows the user to gain practice in gauging how hard to strike the golf ball 28 to accommodate the distance. Preferably, the device 10 may be anchored when in use outdoors by the use of tees pushed through holes 31 in the arms 11, 12 of the device 10 and into the putting green surface, thereby anchoring the device 10 in place on the putting green.

While the principles of the invention have been described in connection with exemplary embodiments, it should be understood clearly that such descriptions are by way of example and are not limiting.

What is claimed is:

1. A putting stroke training device comprising a first arm having a first arm closed end and a first arm open end; a second arm having a second arm closed end and a second arm open end; an elevated arch attached to the first arm at the first arm closed end and to the second arm at the second arm closed end; and means of attachment of the elevated arch to the first arm closed end and the second arm closed end; wherein the first arm is rotatable around the means of attachment between the first arm closed end and the elevated arch and the second arm is rotatable around the means of attachment between the second arm closed end and the elevated arch.

2. The device of claim 1 wherein the elevated arch is of a sufficient dimension to allow the passage of a golf ball therethrough on a line dividing the device along its length.

3. The device of claim 2 wherein the second arm is connected at the second arm open end to a ball position marker extending perpendicular to the line dividing the device along its length.

4. The device of claim 3 wherein the ball position marker can be removably detached from the second arm open end and affixed to the first arm open end.

5. The device of claim 2 further comprising means for catching the golf ball traveling therethrough.

6. The device of claim 5 wherein the means for catching the golf ball is a net removably attached to the device.

7. The device of claim 6 wherein the elevated arch has an elevated arch right side and an elevated arch left side and the net is removably attached to the elevated arch on the elevated arch right side and the elevated arch left side.

8. The device of claim 6 wherein the net is removably attached to the elevated arch by means of Velcro.

9. The device of claim 1 wherein the means of attachment of the first arm closed end to the elevated arch and the second arm closed end to the elevated arch is wing nuts and screws.

10. The device of claim 1 wherein the rotatable means of attachment between the first arm closed end and the elevated arch and the rotatable means of attachment between the second arm closed end and the elevated arch are lock stepped grooves.

11. The device of claim 1 wherein the first arm and second arm each contain means for stabilizing the device.

12. The device of claim 11 wherein the means for stabilizing the device are anchors.

13. The device of claim 11 wherein the first arm and the second arm have at least one hole therethrough whereby stabilizing means may pass therethrough.

14. The device of claim 13 wherein the stabilizing means are tees.

15. The device of claim 1 having a first arm guide ball affixed to the first arm open end and a second arm guide ball affixed to the second arm open end.

16. The device of claim 1 wherein the first arm is a mirror image of the second arm.

17. The device of claim 1 wherein the device has a horseshoe-like curved shape.

18. A putting device comprising a first arm having a first arm closed end and a first arm open end; a second arm having a second arm closed end and a second arm open end; an elevated arch attached to the first arm at the first arm closed end and to the second arm at the second arm closed end; and means of attachment of the elevated arch to the first arm closed end and the second arm closed end; wherein the first arm is rotatable around the means of attachment between the first arm closed end and the elevated arch and the second arm is rotatable around the means of attachment between the second arm closed end and the elevated arch; and wherein the means of attachment of the first arm closed end to the elevated arch and the second arm closed end to the elevated arch is wing nuts and screws.

19. The device of claim 18 wherein the elevated arch is of sufficient dimensions to allow the passage of a golf ball therethrough on a path dividing the device along its length.

20. A putting stroke straining device comprising a first arm having a first arm closed end and a first arm open end; a second arm having a second arm closed end and a second arm open end; an elevated arch attached to the first arm at the first arm closed end and to the second arm at the second arm closed end; and means of attachment of the elevated arch to the first arm closed end and the second arm closed end; wherein the first arm is rotatable around the means of attachment between the first arm closed end and the elevated arch and the second arm is rotatable around the means of attachment between the second arm closed end and the elevated arch; and wherein the device has a horseshoe-like curved shape.

* * * * *